United States Patent [19]

Bosch

[11] Patent Number: 5,012,577

[45] Date of Patent: May 7, 1991

[54] SHAVING APPARATUS

[75] Inventor: Sieds Bosch, Drachten, Netherlands

[73] Assignee: U.S. Philips Corp., N.Y.

[21] Appl. No.: 484,702

[22] Filed: Feb. 23, 1990

[30] Foreign Application Priority Data

Feb. 23, 1989 [NL] Netherlands ..... 8900446

[51] Int. Cl.[5] ..... B26B 19/14; B26B 19/04

[52] U.S. Cl. ..... 30/43.6; 30/346.51

[58] Field of Search ..... 30/43, 43.1, 43.2, 43.3, 30/43.4, 43.5, 43.6, 43.7, 34.2, 346.51

[56] References Cited

U.S. PATENT DOCUMENTS

| | | | |
|---|---|---|---|
| 3,233,323 | 2/1966 | Driessen | 30/43.6 |
| 4,281,453 | 8/1981 | Bakker et al. | 30/346.51 |
| 4,413,410 | 11/1983 | Otsuka et al. | 30/43.6 |
| 4,475,285 | 10/1984 | Hark et al. | 30/43.6 |
| 4,675,998 | 6/1987 | Thijsse | 30/43.6 |
| 4,688,329 | 8/1987 | Oord | 30/43.6 |
| 4,711,028 | 12/1987 | Bergsma | 30/43.6 |
| 4,839,964 | 6/1989 | Uchiyama et al. | 30/43.6 |
| 4,882,840 | 11/1989 | Tietjens | 30/43.6 |

*Primary Examiner*—Douglas D. Watts
*Assistant Examiner*—Paul M. Heyrana, Sr.
*Attorney, Agent, or Firm*—Ernestine C. Bartlett

[57] ABSTRACT

A shaving apparatus is provided which comprises a holder for at least one shaving unit, which shaving unit comprises an external shaving member formed with hair-entry apertures and an internal shaving member which is rotatable relative to the external shaving member, the shaving unit being arranged in an opening of the holder and being retained by means of a retaining plate which is detachably secured to the holder, the holder and the retaining plate comprising corresponding fixing means. The fixing means comprise a latching arm on the retaining plate and a corresponding latching projection on the holder near the circumference of the retaining plate, the latching arm comprising a latching portion at one end and, at the other end, a connecting portion for the connection to the retaining plate, which latching arm comprises an arm portion which is rotatable relative to the retaining plate and an arm portion which is rectilinearly movable relative to the retaining plate, which two arm portions are interconnected by a bent resilient arm portion, the retaining plate comprising means for the connection to the connecting portion and guide means for the rectilinearly movable arm portion.

5 Claims, 3 Drawing Sheets

SHAVING APPARATUS

FIELD OF THE INVENTION

The invention relates to a shaving apparatus comprising a holder for at least one shaving unit, which shaving unit comprises an external shaving member formed with hair-entry apertures and an internal shaving member which is rotatable relative to the external shaving member, the shaving unit being arranged in an opening of the holder and being retained by means of a retaining plate which is detachably secured to the holder, the holder and the retaining plate comprising corresponding fixing means.

BACKGROUND OF THE INVENTION

Such a shaving apparatus is known from EP-A-87200074.0 which corresponds substantially to U.S. Pat. No. 4,711,028 issued Dec. 8, 1987. In this known apparatus the fixing means are arranged in a central position between a plurality of shaving units. However, the space available at this location is generally scarce and, in addition, the forces exerted on the shaving units during shaving cannot be absorbed to an optimum extent as a result of this central arrangement.

SUMMARY OF THE INVENTION

An object of the invention is to mitigate these problems and to this end the invention is characterized in that the fixing means comprise a latching arm on the retaining plate and a corresponding latching projection on the holder near the circumference of the retaining plate, the latching arm comprising a latching portion at one end and, at the other end, a connecting portion for the connection to the retaining plate, which latching arm comprises an arm portion which is rotatable relative to the retaining plate and an arm portion which is rectilinearly movable relative to the retaining plate, which two arm portions are interconnected by a bent resilient arm portion, the retaining plate comprising means for the connection to the connecting portion and guide means for the rectilinearly movable arm portion.

In special embodiments of the invention, the retaining plate comprises a plurality of connecting arms with a common connection portion; the connecting portion is rotatably supported on the retaining plate; the latching arm comprises an actuating element; and the retaining plate comprises two latching arms which are symmetrical relative to the axis of rotation of the connecting portions which latching arm can be actuated, the retaining plate being disengageable by oppositely directed forces acting upon the latching arms and directed substantially along a connecting line between the shaving units.

BRIEF DESCRIPTION OF THE DRAWINGS

Some embodiments of the invention will now be described in more detail, by way of example, with reference to the Figures.

DETAILED DESCRIPTION OF PREFERRED EMBODIMENTS

Figure 1:
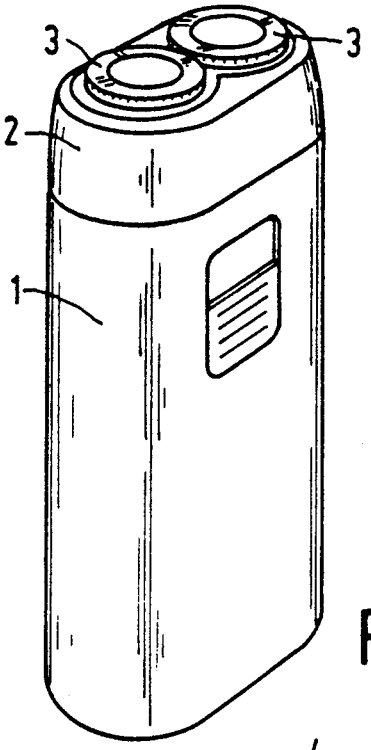
FIG. 1 is a perspective view of a shaving apparatus in accordance with the invention.

The shaving apparatus shown in FIG. 1 comprises a housing 1 with a holder 2 and two shaving units 3.

Figure 4:
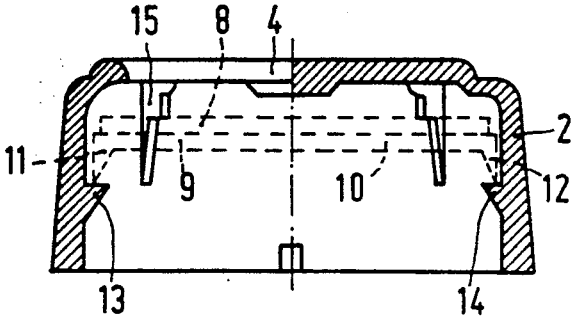
FIG. 4 is a sectional view taken on the line IV—IV in FIG. 2.
Figure 2:
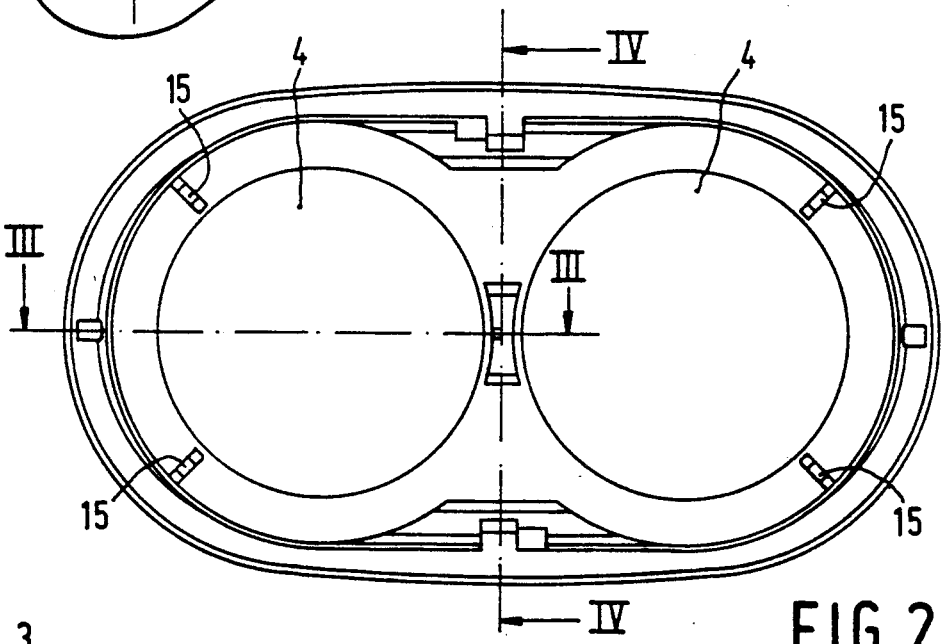
FIG. 2 is an underneath view of the holder of the shaving apparatus shown in FIG. 1.
Figure 3:
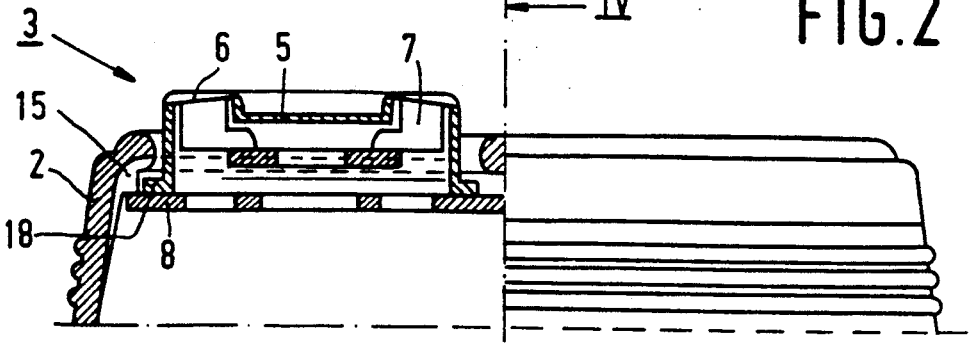
FIG. 3 shows the holder in a side view and partly in a sectional view taken on the line III—III in FIG. 2.

The holder 2, as is shown in FIGS. 2 to 4, has two openings 4 for the shaving units 3. The left-hand part of FIG. 3, which is a sectional view of the holder, also shows a shaving unit 3 and a retaining plate 8. This shaving unit comprises an external shaving member 5 formed with hair-entry apertures 6 and an internal shaving member 7 which is rotatable relative to the external shaving member. The shaving units are retained in the holder by means of a retaining plate 8 which is detachably connected to the holder and which bears against stops 15 which are integral with the holder 2. The retaining plate 8 is shown in broken lines in FIG. 4 and comprises latching arms 9 and 10 having latches, 11 and 12 respectively, at their ends. The latches 11 and 12 engage behind respective projections 13 and 14 of the holder 2.

The retaining plate 8 and the latching arms 9 and 10 are shown diagrammatically in FIG. 3 and 4 but are shown in greater detail in FIGS. 5 to 10.

Figure 5:
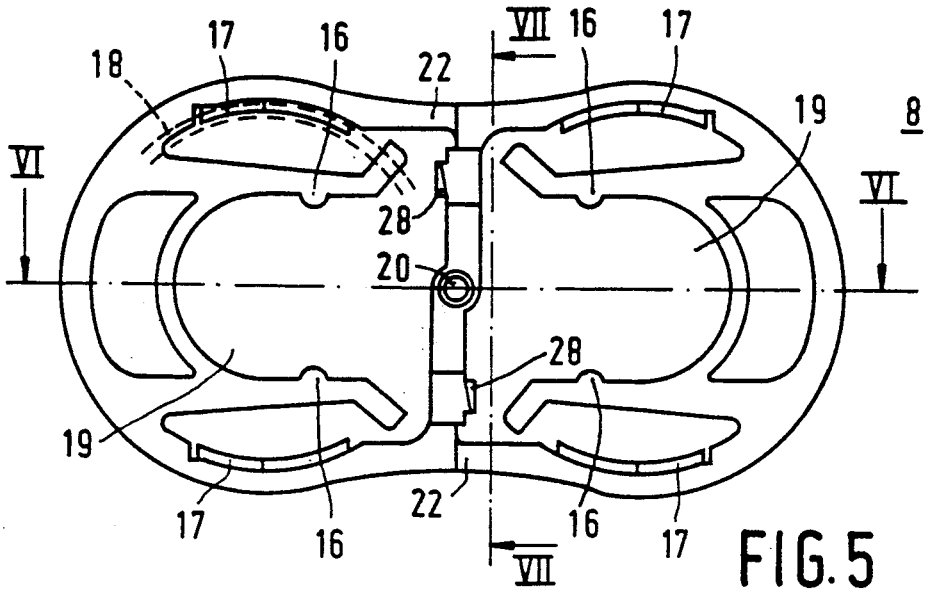
FIG. 5 is a plan view of a retaining plate.
Figure 6:
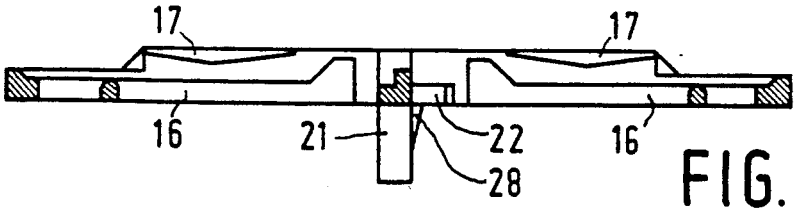
FIG. 6 is a sectional view taken on the line VI—VI in FIG. 5.
Figure 7:
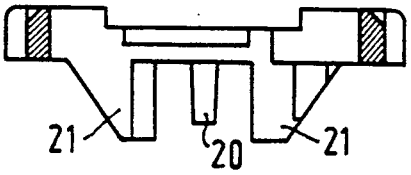
FIG. 7 is a sectional view taken on the line VII—VII in FIG. 5.
Figure 8:
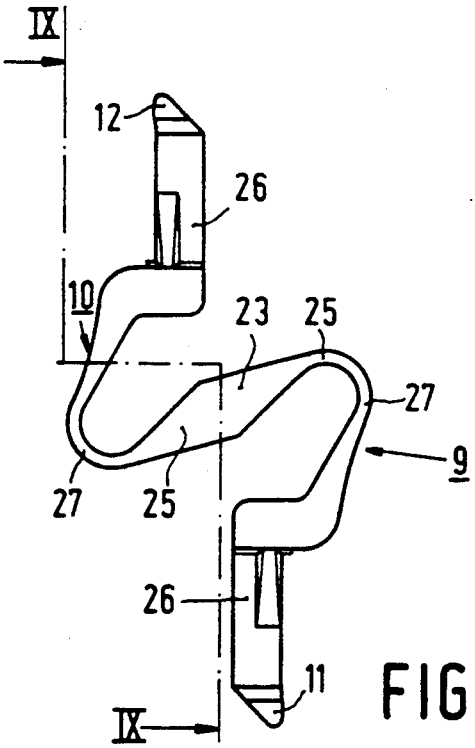
FIG. 8 shows a latching arm.

As is shown in FIG. 5, the retaining plate 8 comprises resilient arms 16 and overhanging wall portions 17. The flanged rim 18 of an external shaving member, as is indicated in broken lines in FIG. 5, is clamped between the resilient arms 16 and the overhanging wall portions 17. The rotatable shaving member 7 is thus retained between the external shaving member 5 and the retaining plate 8. Openings 19 between the resilient arms 16 enable the rotatable internal shaving member to be coupled to a drive mechanism, known per se, to drive the internal shaving member with rotary movements. The retaining plate 8 also comprises a central journal 20 and guide projections 21 and guide slots 22 for the latching arms 9 and 10.

Figure 9:
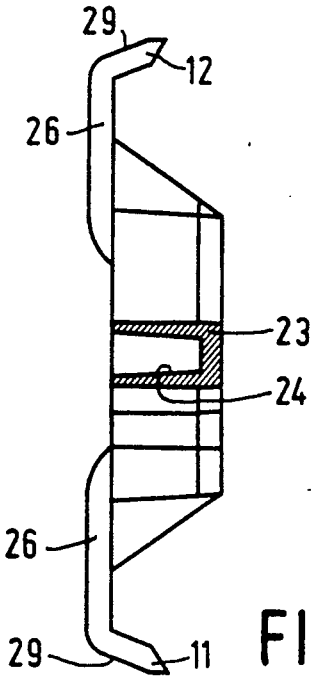
FIG. 9 shows the latching arm in a side view and partly in a sectional view taken on the line IX—IX in FIG. 8.
Figure 10:
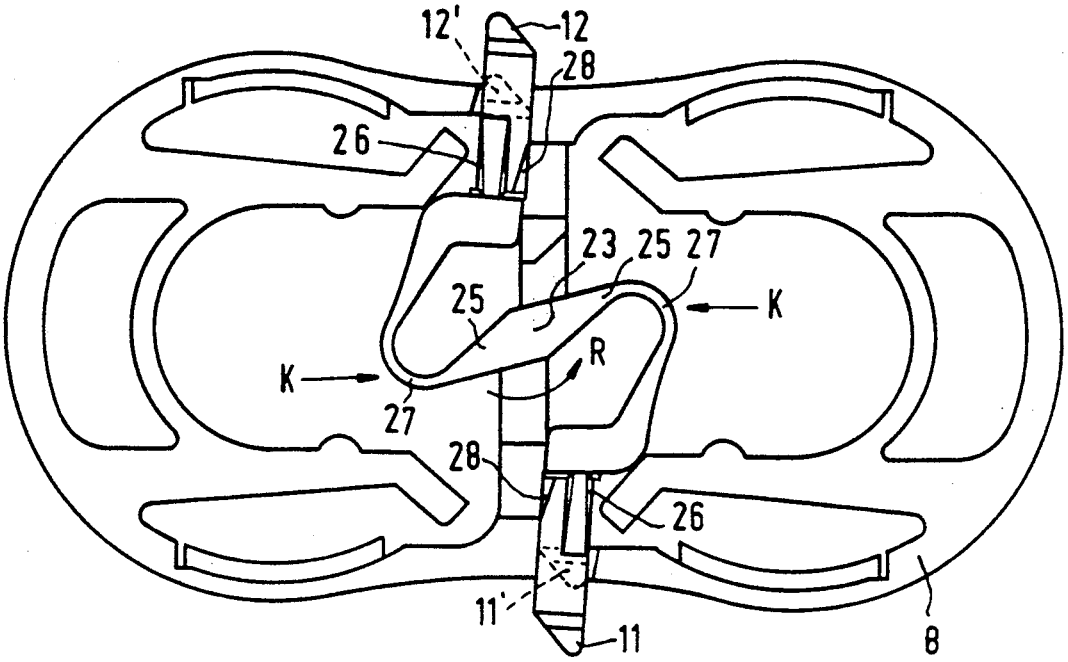
FIG. 10 shows the combination of a retaining plate and a latching arm in a simplified view similar to FIG. 5.

The two latching arms 9 and 10 (FIGS. 8 and 9) have a common connecting portion 23 provided with a hub 24 corresponding to the journal 20 and shown in sectional view in FIG. 9. A latching arm 9 comprises a rotatable arm portion 25 and a rectilinearly movable arm portion 26. The arm portions 25 and 26 are interconnected by a bent resilient arm portion 27.

In the assembled condition of the retaining plate 8 and the latching arms 9 and 10 the hub 24 is rotatably supported on the journal 20 and the rectilinearly movable arm portions 26 have engaged in the slots 22 in the retaining plate. The guide projections each comprise a projecting portion 28 to retain the arm portions 26 in the slots.

When the retaining plate has been secured to the holder 2 the latches 11 and 12 engage behind the projections 13 and 14 of the holder. If by means of a thumb and forefinger substantially opposed forces K (FIG. 10) which do not act along the same line are exerted on the latching arms 9 and 10 the central connecting portion 23 will be rotated slightly in the direction of rotation R as a result of the torque to which it is subjected. The rotatable arm portions 25 will also be rotated slightly in this direction of rotation. This causes the latches 11 and 12 to be moved to position 11' and 12' respectively, as indicated in broken lines. The latches 11 and 12 are now disengaged from the respective projections 13 and 14, so that the retaining plate 8 can be removed from the holder 2. When the retaining plate is mounted in the holder the latches will also be brought in the positions 11'' and 12'' under the influence of the forces K. After the retaining plate has been fitted in the holder the latching arms are released. The forces K have caused the bent arm portions 27 to be deformed elastically. When the latching arms are released this elastic deformation will cause the latches to reengage behind the projections 13 and 14. However, it is also possible to mount the retaining plate in the holder without operating the latching mechanism. This is because the latches 11 and 12 have bevelled edges 29 which slide over the projections 13 and 14 when the retaining plate 8 is placed into the holder, after which the latches eventually snap behind these projections.

In this way a simple latching mechanism is obtained, which can be manufactured easily as an integral injection-molded part and which occupies minimal space. Latching is effected at the circumference of the retaining plate, resulting in a more stable mounting of this plate in the holder. Particularly in the case of a shaving apparatus comprising only two shaving units the space available in the holder for manipulating the retaining plate is very small. However, this problem is solved by means of the above embodiment because a thumb and forefinger can be placed approximately at the level of the shaving units, the squeezing movement of the fingers towards each other being converted into a release movement directed perpendicularly thereto.

Figure 11:
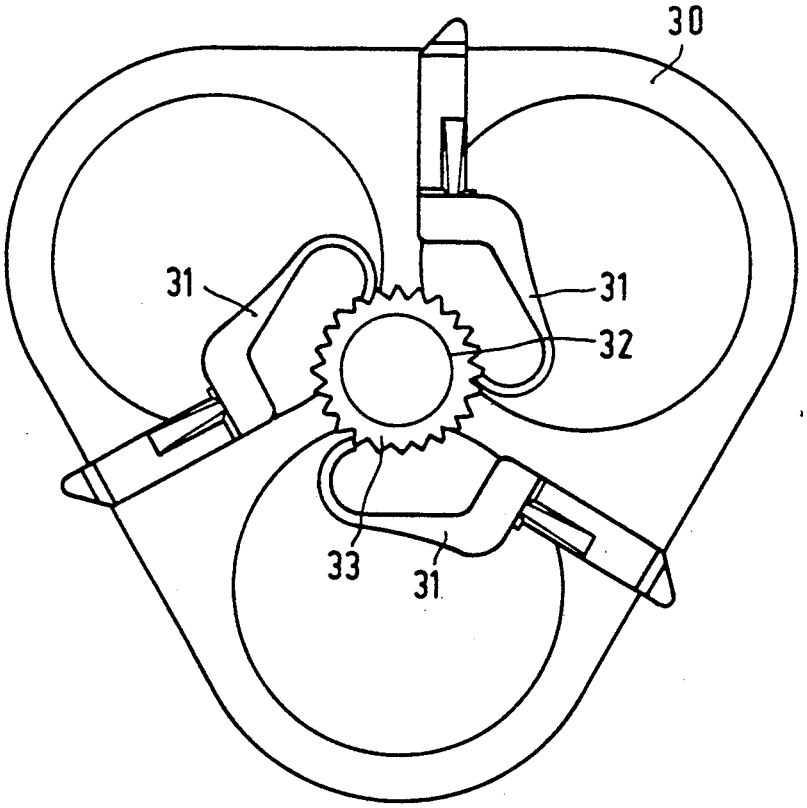
FIG. 11 shows a modification of the embodiment shown in FIGS. 1 to 10 in a view of a retaining plate as shown in FIG. 10.

Obviously, the invention may also be applied to a shaving apparatus comprising another number of shaving units than illustrated in FIG. 11. The retaining plate 30 for an apparatus comprising three shaving units has three latching arms 31 which are centrally connected to a common connecting portion 32. This connecting portion 32 has an actuating knob 33 to rotate the connecting portion 32. For the remainder its operation is identical to that of the embodiment described with reference to FIGS. 1 to 10.

I claim:

1. A shaving apparatus comprising a holder for at least one shaving unit, which shaving unit comprises an external shaving member formed with hair-entry apertures and an internal shaving member which is rotatable relative to the external shaving member, the shaving unit being arranged in an opening of the holder and being retained by means of a retaining plate which is detachably secured to the holder, the holder and the retaining plate comprising corresponding fixing means, wherein the fixing means comprise a latching arm on the retaining plate and a corresponding latching projection on the holder near the circumference of the retaining plate, the latching arm comprising a latching portion at one end and, at the other end, a connecting portion for the connection to the retaining plate, which latching arm comprises an arm portion which is rotatable relative to the retaining plate and an arm portion which is rectilinearly movable relative to the retaining plate, which two arm portions are interconnected by a bent resilient arm portion, the retaining plate comprising means for the connection to the connecting portion and guide means for the rectilinearly movable arm portion.

2. A shaving apparatus as claimed in claim 1, wherein the retaining plate comprises a plurality of connecting arms with a common connecting portion.

3. A shaving apparatus as claimed in claim 1 or 2, wherein the connecting portion is rotatably supported on the retaining plate.

4. A shaving apparatus as claimed in claim 1, wherein the latching arm comprises an actuating element.

5. A shaving apparatus as claimed in claim 3, comprising two shaving units, wherein the retaining plate comprises two latching arms which are symmetrical relative to the axis of rotation of the connecting portion, which latching arms can be actuated, the retaining plate being disengageable by oppositely directed forces acting upon the latching arms and directed substantially along a connecting line between the shaving units.

* * * * *